US011112124B2

(12) United States Patent
Breneman et al.

(10) Patent No.: US 11,112,124 B2
(45) **Date of Patent: *Sep. 7, 2021**

(54) HINGED COOKTOP GRATE ASSEMBLY

(71) Applicant: Whirlpool Corporation, Benton Harbor, MI (US)

(72) Inventors: Samuel B. Breneman, St. Joseph, MI (US); Michael A. Kahwaji, St. Joseph, MI (US); Andrew C. Kubasiak, St. Joseph, MI (US); Jason Scott Lind, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 726 days.

This patent is subject to a terminal disclaimer.

(21) Appl. No.: 15/902,695

(22) Filed: Feb. 22, 2018

(65) Prior Publication Data

US 2018/0180294 A1 Jun. 28, 2018

Related U.S. Application Data

(63) Continuation of application No. 13/862,903, filed on Apr. 15, 2013, now Pat. No. 9,903,593.

(51) Int. Cl.
*F24C 15/10* (2006.01)

(52) U.S. Cl.
CPC ..... *F24C 15/107* (2013.01)

(58) Field of Classification Search
CPC ..... F24C 15/107; F24C 15/10
See application file for complete search history.

(56) References Cited

U.S. PATENT DOCUMENTS

| | | | | |
|---|---|---|---|---|
| 1,263,203 | A | 4/1918 | Burnett | |
| 2,341,537 | A | 2/1944 | Froelich | |
| 2,444,862 | A | 7/1948 | Thomas | |
| 2,528,333 | A | 10/1950 | Biddle | |
| 4,155,343 | A | 5/1979 | Hartman | |
| 4,173,802 | A | 11/1979 | Wikstrom | |
| 4,390,114 | A * | 6/1983 | Sviatoslavsky | F21V 17/12 220/4.02 |
| 4,390,144 | A * | 6/1983 | Mueller | B65H 75/26 242/118.3 |
| 4,517,955 | A | 5/1985 | Ehrlich | |
| 4,701,977 | A | 10/1987 | Hori | |

(Continued)

FOREIGN PATENT DOCUMENTS

| | | |
|---|---|---|
| EP | 0505806 | 9/1992 |
| GB | 184334 | 8/1922 |
| WO | 2012/083348 | 6/2012 |

*Primary Examiner* — Avinash A Savani
*Assistant Examiner* — Deepak A Deean
(74) *Attorney, Agent, or Firm* — Diederiks & Whitelaw, PLC

(57) ABSTRACT

A cooking appliance includes a cooktop, at least one cooking element mounted to the cooktop, and a grate including a surface portion for supporting a cooking vessel and at least one cup member. The grate is mounted to the cooktop with the at least one cup member being interengaged with locating structure on the cooktop such that the grate can be selectively lifted vertically from the cooktop or pivoted relative to the cooktop. Upon pivoting through a predetermined angle, the grate is prevented from being lifted vertically based on the at least one cup member becoming interlocked with the locating structure.

20 Claims, 4 Drawing Sheets

(56) References Cited

U.S. PATENT DOCUMENTS

| | | | | |
|---|---|---|---|---|
| 4,869,231 | A | 9/1989 | Rice et al. | |
| 4,974,262 | A | 12/1990 | Rosen | |
| 5,039,154 | A | 8/1991 | Lewis | |
| 5,231,732 | A | 8/1993 | Knoop | |
| 5,415,058 | A | 5/1995 | Young | |
| 5,813,396 | A | 9/1998 | Bessette | |
| 5,857,239 | A | 1/1999 | Oh | |
| 6,173,708 | B1 | 1/2001 | Arntz et al. | |
| 6,399,924 | B1 * | 6/2002 | Cai | F24C 15/12 126/211 |
| 6,491,621 | B1 | 12/2002 | Dykes | |
| 6,978,778 | B2 | 12/2005 | Hawkins et al. | |
| 7,156,441 | B2 | 1/2007 | Austin | |
| 7,500,706 | B2 | 3/2009 | Anderson | |
| 7,549,691 | B2 | 6/2009 | Schulte | |
| 8,696,046 | B2 | 4/2014 | Sackett | |
| 2008/0030631 | A1 | 2/2008 | Gallagher | |
| 2008/0235907 | A1 * | 10/2008 | Wayman | E05D 7/105 16/361 |
| 2010/0078006 | A1 | 4/2010 | Williams | |
| 2011/0114077 | A1 * | 5/2011 | Mishra | F24C 15/107 126/39 R |

* cited by examiner

HINGED COOKTOP GRATE ASSEMBLY

CROSS REFERENCE TO RELATED APPLICATIONS

This application is a continuation of U.S. patent application Ser. No. 13/862,903, filed on Apr. 15, 2013, the entire contents of which are incorporated herein by reference.

BACKGROUND OF THE INVENTION

Field of the Invention

The present invention pertains to the art of cooking appliances and, more particularly, to a method and apparatus for locating a grate over cooking elements on a cooktop.

Description of the Related Art

A conventional gas cooking appliance incorporates a cooktop which is generally formed of either coated metal or glass. The cooktop is provided with various openings for receiving gas operated burners. More specifically, each gas burner projects through the cooktop and is either fixedly or loosely secured to the cooktop. U.S. Pat. No. 6,173,708 represents one known mounting arrangement for a gas burner on a cooktop. With gas burner arrangements of this type, at least one cooking area includes an associated gas burner arranged below a vessel support, such as a metal grate. The vessel support must have a surface for resting a cooking vessel, and feet for raising the support above the cooktop. The cooking vessel support must be arranged so that it is directly above the gas burner and relatively fixed in position, so that the energy transfer from the burner to the cooking vessel is optimized. Such a fixing arrangement is typically constituted by locating projections on the grate which mate with locating recesses provided on the cooktop. In this fashion, the grate can be lifted from the cooktop when desired and can only be properly seated in a specified manner to assure the desired efficient energy transfer.

Of course, use of such a cooking arrangement can create spills which need to be cleaned, typically after each use. However, the grates employed on gas cooktops tend to be fairly heavy and can be awkward to remove for cleaning. When a grate is removed for cleaning of a cooktop, the grate must be placed with care so as to not scratch or otherwise damage the surface upon which it is placed, such as adjacent countertop space. As the selective removal, temporary storing and repositioning of grates can create potential obstacles, it has been proposed to hingedly attach a grate to a cooktop, thereby enabling the grate to be pivoted between raised and lowered positions. As certain advantages can be attributed to both completely removable and hinged grate arrangements, the present invention provides a particular gas cooking grate mounting arrangement which provides for the grate to be selectively lifted completely off the cooktop or pivoted to a raised, out-of-the-way position.

SUMMARY OF THE INVENTION

The present invention is directed to a cooking appliance having a cooktop and at least one cooking element, such as a gas cooking element. Above each cooking element is mounted a grate assembly which includes at least one grate defining a surface portion for supporting a cooking vessel and a hinge mount for both locating the grate relative to the cooking element and supporting the grate for selective pivotal movement relative to the cooking element.

In accordance with one aspect of the invention, the hinge mount is fixed to a portion of the cooktop and includes locating structure which is received in cup members provided on the grate when the grate is appropriately positioned over the cooking element. The locating structure allows the grate to be selectively lifted vertically from the cooktop or pivoted relative to the cooktop. When pivoted through a predetermined angle, the locating structure becomes interlocked with the cup members, thereby preventing the grate from being lifted from the cooktop. At the same time, the locating structure defines a hinge axis about which the grate can pivot, allowing access to below the grate for cleaning or other purposes. When the cooktop is mounted adjacent an upstanding rear wall and the locating structure is provided along a rear portion of the cooktop, the grate can be conveniently pivoted and leaned against the wall.

Based on the above, it should be readily apparent that the present invention enables a cooktop grate to be conveniently and selectively repositioned from a position directly over a cooking element in multiple ways with a multi-functioning grate mounting arrangement. In any case, additional objects, features and advantages of the present invention will become more readily apparent from the following detailed description of preferred embodiments when taken in conjunction with the drawings wherein like reference numerals referring to corresponding parts in the several views.

DETAILED DESCRIPTION OF PREFERRED EMBODIMENTS

Figure 1:
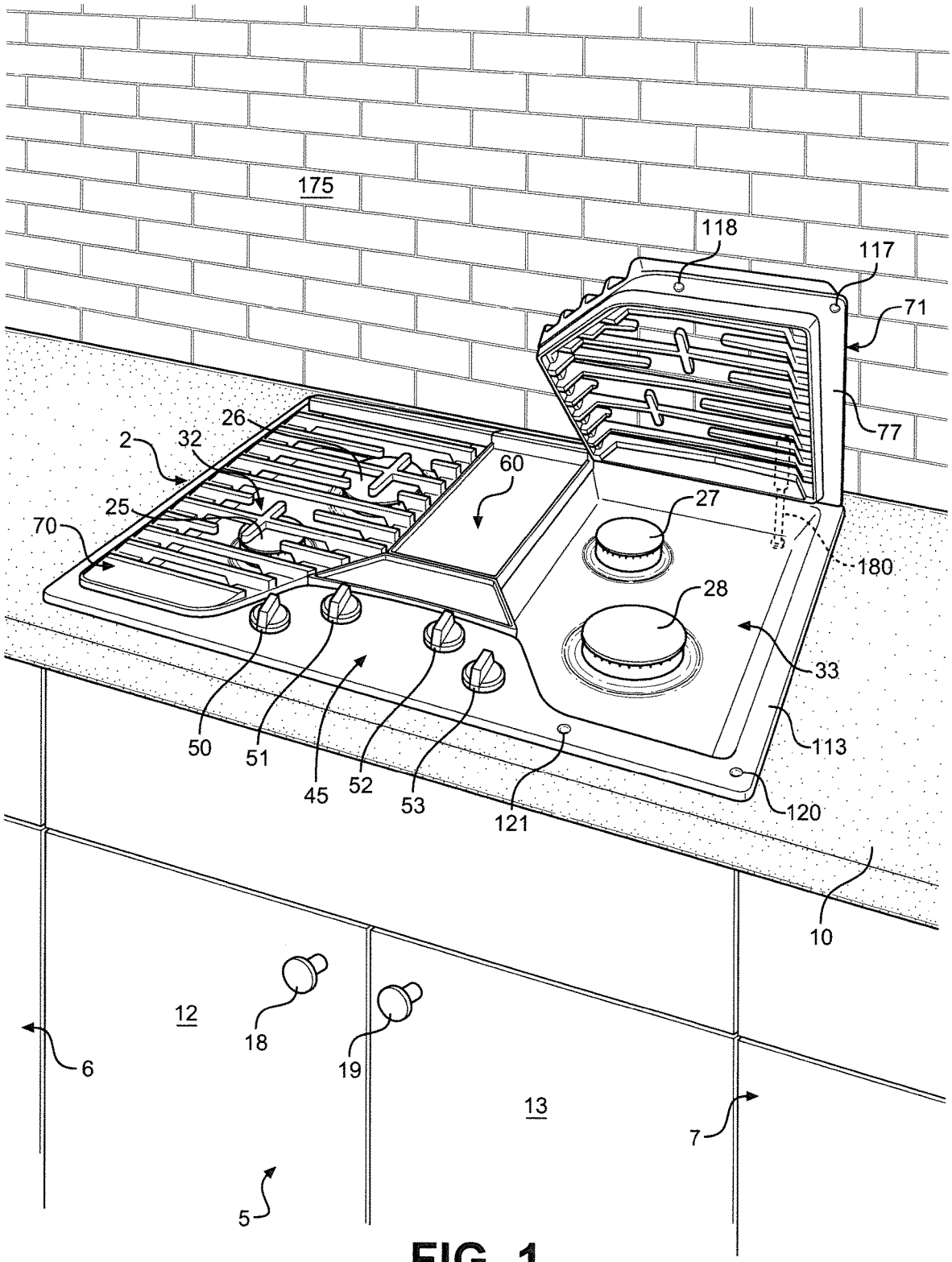
FIG. 1 is an upper right perspective view of a cooktop mounted in a countertop and including a grate assembly in accordance with the invention.

With initial reference to FIG. 1, the present invention is concerned with a cooking appliance which is shown as a countertop mounted cooktop 2. However, at this point, it should be realized that the present invention could also be used in connection with various types of cooking appliances, including domestic ranges and island cooktops. In any event, for exemplary purposes, lower cabinets 5-7 are shown positioned below a countertop 10, with cabinet 5 including front doors 12 and 13 provided with handles 18 and 19 for accessing a storage region (not shown) within cabinet 5. In accordance with the illustrated embodiment, cooktop 2 operates on gas and therefore is shown to include a series of gas cooking elements, such as sealed gas burners 25-28. Although the particular number and arrangement of gas burners 25-28 can greatly vary in accordance with the invention, cooktop 2 is shown in exemplary form to include symmetrical sump regions 32 and 33 within which respective sets of gas burners 25, 26 and 27, 28 are mounted. In addition, cooktop 2 includes a control region 45 provided with control elements, shown here in the exemplary form of rotary knobs 50-53, for regulating the operation of gas burners 25-28 respectively. Between sump regions 32 and 33 and behind control region 45 is a raised central portion 60 of cooktop 2. In a manner known in the art and not part of the present invention, central region 60 can be designed for various purposes, such as a generally flat region to support cooking related items or open to establish an air flow path in connection with forced convection venting for cooking operations. In general, the construction and operation of cooktop 2, as described until this point, is known in the art such that this description has merely been provided for the sake of completeness. To this end, additional details of this construction or operation will not be provided here.

Figure 2:
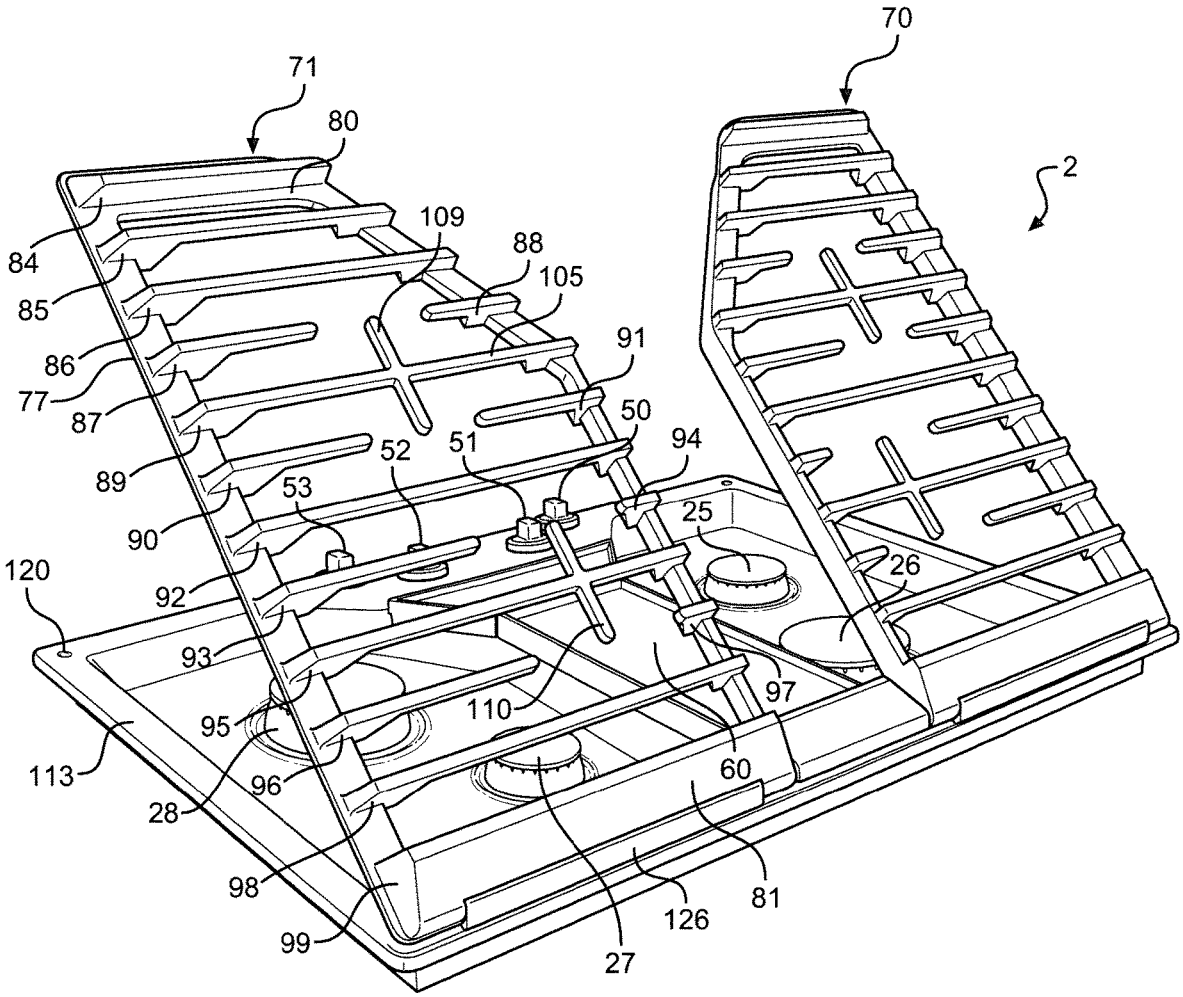
FIG. 2 is a rear perspective view of the cooktop of FIG. 1 with multiple grates of the grate assembly shown positioned in partially raised positions.

As also shown in FIG. 1, burners 25-28 are covered by grates 70 and 71 upon which pots, pans and other cooking vessels (not shown) can be supported in performing cooking operations. As the construction of grates 70 and 71 are substantially identical, i.e., grates 70 and 71 are mirror images of each other, a detailed description will now be made of the structure of grate 71 and it is to be understood that grate 70 has corresponding structure. As perhaps best shown in FIG. 2, grate 71 includes a perimeter body portion 77 and is defined, at least in part, by a front body portion 80 and a rear body portion 81. Between front body portion 80 and rear body portion 81 are a plurality of support arms 84-99, each of which has an uppermost planar surface 105, with the various uppermost planar surfaces 105 preferably extending in a common, substantially horizontal plane. As will be readily apparent from viewing this figure, support arms 84-99 can have associated therewith various lengths and can take various forms. For instance, support arms 84-86, 89, 92, 95, 98 and 99 extend entirely across and are directly engaged with opposing side sections (not separately labeled) of perimeter body portion 77, while support arms 87, 88, 90, 91, 93, 94, 96 and 97 only extend partially across grate 71. Of these partially extending support arms, the associated lengths thereof can also greatly vary, such as represented by the elongated support arm 96 and the shortened support arm 97. In addition, certain ones of the support arms 84-99 can include cross arm portions, such as shown by cross arm portions 109 and 110 for support arms 89 and 95. In the embodiment shown, the use of cross arm portions 109 and 110 are strategically arranged to be directly over the associated burners 28 and 27 respectively, in order to not only provide additional support for cooking vessels but also aiding in properly locating the cooking vessels over the associated burners 25-28 for the user. Again, the particular number, arrangement and configuration of the support arms and cross arms of the grates can greatly vary without departing from the spirit of the invention.

During use, each grate 70, 71 is adapted to set upon a rim 113 of cook top 2. More specifically, perimeter body portion 77 extends about a portion of rim 113 and rests thereon. Positioning members can be provided for locating each grate 70, 71 over the respective burners 25, 26 and 27, 28. As best shown in FIG. 1, these positioning members can take the form of convex projections 117 and 118 provided at spaced locations along perimeter body portion 77 of grate 71, with convex projections 117 and 118 cooperating with aligned, concave recesses 120 and 121 provided at respective locations along rim 113. To aid in protecting the finish of cooktop 2, specifically rim 113, projections 117 and 118 can be formed of elastomeric, plastic or the like materials. As will be detailed below, a particular concern in connection with the present invention is the manner in which each grate 70, 71 is mounted for selective pivotal movement relative to the remainder of cooktop 2.

Figure 3:
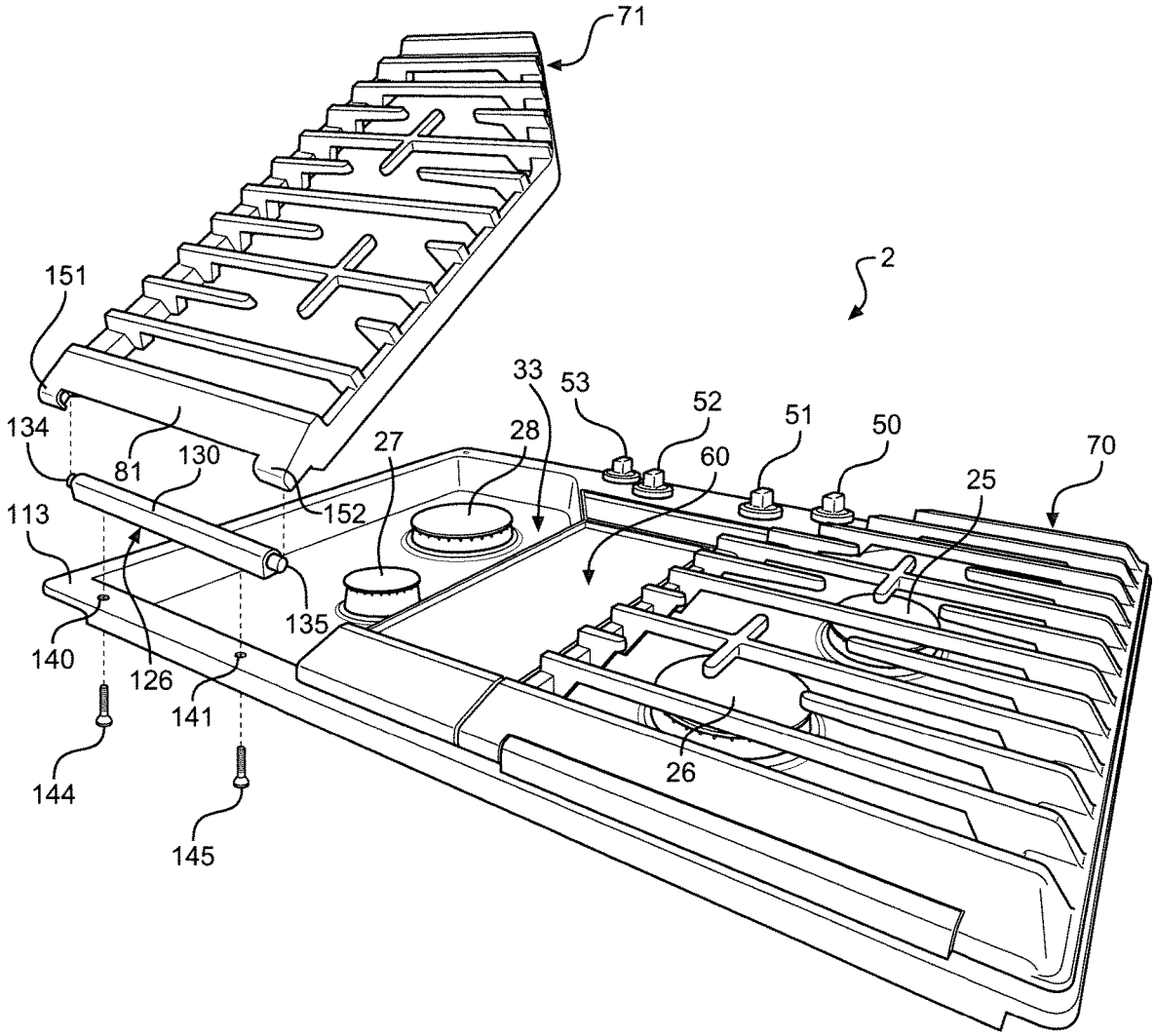
FIG. 3 is another perspective view of the cooktop of FIG. 2 with one grate assembly shown in exploded form.

With particular reference to FIG. 3, this aspect of the invention is carried out by providing a hinge mount, generally indicated at 126, along a portion of rim 113, preferably adjacent rear body portion 81. More specifically, hinge mount 126 includes a main body portion 130 that defines locating structure shown in the form of outwardly extending projections 134 and 135. In the embodiment shown, projections 134 and 135 take the form of cylindrical stub shafts which are spaced above rim 113 and supported by main body portion 130. In connection with mounting main body portion 130, rim 113 is provided with a pair of spaced holes 140 and 141 through which extend fasteners, such as screws 144 and 145 that threadably engage with main body portion 130. In this manner, hinge mount 126 is fixedly secured to rim 113. As shown in this figure, extending beyond rear body portion 81 of grate 71 is a pair of rear corner ear portions 151 and 152. As will be detailed below, each rear corner ear portion 151, 152 receives and becomes interengaged with a respective projection 134, 135 upon positioning grate 71 upon rim 113.

Figure 4:
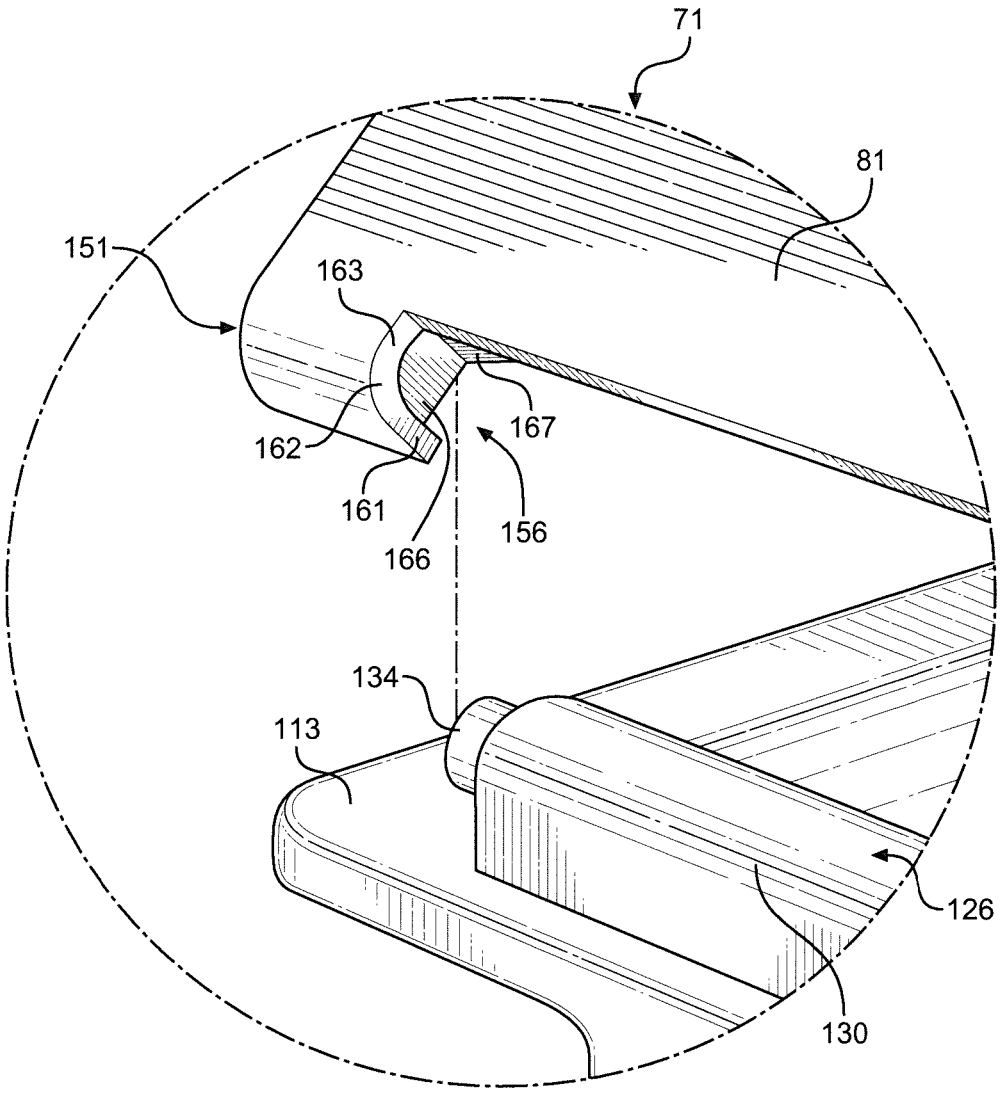
FIG. 4 is an enlarged view of a corner mounting portion for the grate assembly of FIG. 3.

FIG. 4 presents an enlarged, detailed view of a rear corner ear portion 151 of cooktop 2, with grate 71 shown exploded from rim 113 and hinge mount 126. As illustrated, rear corner ear portion 151 defines, at a laterally inward portion thereof, a cup member 156. As shown, cup member 156 is defined by a lower rear wall portion 161 which leads to an arcuate wall portion 162 and a top wall portion 163. With this arrangement, cup member 156 has an open bottom portion. Collectively, wall portions 161-163 establish a lateral inner surface (not labeled) which is adapted to be arranged directly juxtaposed hinge main body portion 130 upon mounting of grate 71 on rim 113 (see other figures). In addition to the above, each rear corner ear portion 151, 152 also includes a recessed upstanding wall 166 and a recessed inner wall 167. Upstanding wall 166 is recessed relative to the inner surface associated with wall portions 161-163 by a distance slightly greater than the distance from which projection 134 extends away from main body portion 130 of hinge mount 126. With this construction, it should be readily apparent that each cup member 156 has an open bottom and is closed off about its sides.

In connection with the invention, each grate 70, 71 can be mounted upon rim 113 by arranging the respective grate 70, 71 in a substantially horizontal position and properly aligning the grate 70, 71 over the respective burners 25-28 such that projections 134 and 135 will be received within the open end portion of a respective cup member 156 as should be readily evident from viewing FIGS. 3 and 4. Once in the mounted and operational position shown for grate 70 in FIG. 3, it is possible to remove grate 70 by simply grabbing select ones of support arms 84-99 and vertically lifting grate 70 until projections 134 and 135 slide relative to and clear the respective cup members 156 provided at rear corner ear portions 151 and 152. At this point, it should be understood that there is some clearance between each cup member 156 and its respective projection 134, 135 such that grate 70, 71 need not be perfectly horizontal to allow this to occur. Therefore, by "substantially horizontal", it is intended to mean that a certain range of angles of the grates 70, 71 relative to the horizontal can be accommodated while still enabling the grate 70, 71 to be readily raised or lowered relative to the remainder of cooktop 2 without projections 134 and 135 obstructing this movement. However, in accordance with the invention, this degree of angling is fairly small, preferably less than 30 degrees and, more preferably, 20 degrees or less relative to the horizontal.

In addition to allowing each grate 70, 71 to be vertically removed from upon cooktop 2 as discussed above, the present mounting configuration also advantageously enables each grate 70, 71 to be raised through a pivoting movement. That is, hinge mount 126 and, more specifically, projections 134 and 135, define a pivot axis about which a respective grate 70, 71 can be rotated upon lifting the grate 70, 71 at front body portion 80. More specifically, upon lifting of a respective grate 70, 71 from front body portion 80, again in the order of 20-30°, lower rear wall portion 161 of cup member 156 will begin to shift under a respective projection 134, 135. Once low rear wall portion 161 is positioned in this manner, the grate 70, 71 can no longer just be vertically lifted relative to burners 25-28. However, arcuate wall portion 161 generally conforms to the curvature of projections 134 and 135 such that the configuration of cup members 156 enables the grate 70, 71 to be guided for pivotal movement from the lower position shown for grate 70 in FIG. 1 to the partially raised position shown from grate 71 in FIGS. 1 and 2. With the disclosed construction, each grate 70, 71 can actually pivoted well beyond 90 degrees, thereby enabling the grate 70, 71 to lean against a rear wall or backsplash indicated at 175 in FIG. 1.

Based on the above, it should be readily apparent that the invention provides for a hinged cooktop grate assembly for use on a cooktop having at least one cooking element with the grate being adapted to support a cooking vessel over the cooking element during cooking operations and with the grate being mounted through a hinge mount which both locates the grate relative to the cooking element and supports the grate for selective pivotal movement relative to the remainder of the cooktop. The hinge mount is fixed to a portion of the cooktop and includes locating structure which receives cup members provided on the grate, while allowing the grate to be selectively lifted vertically from the cooktop or pivoted relative to the cooktop. When pivoted through a predetermined angle, the locating structure becomes interlocked with the cup members, thereby preventing the grate from being lifted from the cooktop. At the same time, this locating structure defines a hinge axis about which the grate can pivot, allowing access to below the grate for cleaning or other purposes. When the cooktop is mounted adjacent to an upstanding rear wall, the locating structure is preferably provided along the rear portion of the cooktop so that the grate can be conveniently pivoted and leaned against the rear wall. In any case, it should be readily apparent that the invention enables a cooktop grate to be conveniently and selectively repositioned from a position directly over one or more cooking elements in multiple ways with a multifunctioning grate mounting arrangement. In connection with pivoting the grate, additional structure can be provided to assist a user. This structure can include various spring assist arrangements or, as shown in phantom at 180 provided on cooktop 2 in FIG. 1, a lift assist unit in the form of one or more telescoping, pneumatic lift units, such as those used in various fields including in the automotive field to aid in lifting or retracting tailgates, trunks, hoods and the like.

Although described with reference to preferred embodiments of the invention, it should be readily understood that various changes and/or modifications can be made to the invention without departing from the spirit thereof. For instance, although the grate mounting arrangement of the invention is described in connection with gas burners, the invention could also be employed with other known types of cooking elements, including electric elements. In any event, in general, the invention is only intended to be limited by the scope of the following claims.

What is claimed is:

1. A cooking appliance comprising:

a cooktop;

at least one cooking element mounted to the cooktop; and a grate including a surface portion for supporting a cooking vessel, wherein the grate is mounted to the cooktop and is configured to be separated from the cooktop only by substantially vertical lifting only when pivoted to any of at least two angles within a range of angles.

2. The cooking appliance of claim 1, wherein the grate includes at least one rear corner ear portion having, at a laterally inward portion thereof, at least one cup member.

3. The cooking appliance according to claim 2, further comprising: a hinge mount fixed to a portion of the cooktop and including a locating structure received in the at least one cup member provided on the grate when the grate is positioned over the at least one cooking element.

4. The cooking appliance according to claim 3, wherein the hinge mount includes a main body portion from which extends the locating structure, said locating structure defining a pivot axis for the grate.

5. The cooking appliance according to claim 4, wherein the cooktop includes a rim, said hinge mount being attached to the rim with a plurality of fasteners.

6. A cooking appliance comprising:

a cooktop;

at least one cooking element mounted to the cooktop;

a grate including a surface portion for supporting a cooking vessel, wherein the grate is mounted to the cooktop and is configured to be separated from the cooktop by vertical lifting only when pivoted to any of at least two angles within a range of angles, wherein the grate includes at least one rear corner ear portion having, at a laterally inward portion thereof, at least one cup member; and a hinge mount fixed to a portion of the cooktop and including a locating structure received in the at least one cup member provided on the grate when the grate is positioned over the at least one cooking element, wherein the hinge mount includes a main body portion from which extends the locating structure, said locating structure defining a pivot axis for the grate and comprising a pair of projections extending in opposing directions from the main body portion of the hinge mount.

7. The cooking appliance according to claim 6, wherein the grate includes a front body portion, a rear body portion and a perimeter body portion, said at least one rear corner ear portion extending beyond the rear body portion of the grate.

8. The cooking appliance according to claim 7, wherein said at least one cup member includes a pair of cup members.

9. The cooking appliance according to claim 8, wherein each of said pair of cup members is defined by a lower rear wall portion, an arcuate wall portion, a top wall portion and an open bottom portion for receiving a respective one of said pair of projections.

10. The cooking appliance according to claim 9, wherein the grate is configured to be vertically lifted from the cooktop with the pair of projections sliding through the open bottom portions of the pair of cup members.

11. The cooking appliance according to claim 10 wherein, upon pivoting of the grate through a predetermined angle, the lower rear wall portion extends below a portion of a respective said one of said pair of projections, thereby preventing the grate from being vertically lifted from the cooktop.

12. The cooking appliance according to claim 7, wherein the perimeter body portion is adapted to rest upon the cooktop when the surface portion extends in a substantially horizontal plane.

13. The cooking appliance according to claim 12, further comprising: positioning members provided on the perimeter body portion, with the positioning members aligning with recesses provided on a rim of the cooktop.

14. The cooking appliance according to claim 1, further comprising: a lift assist unit provided on the cooktop for aiding a user in pivoting the grate relative to the cooktop.

15. A method of mounting a grate including a surface portion for supporting a cooking vessel over at least one cooking element of a cooktop of a cooking appliance, said method comprising: mounting the grate to the cooktop with the grate being initially separable from the cooktop by vertically lifting of the grate only when the grate is pivoted to any of at least two angles within a range of angles.

16. The method of claim 15 wherein, upon pivoting through a predetermined angle, the grate is prevented from being lifted vertically based on at least one cup member, provided on at least one rear corner ear portion of the grate, becoming interlocked with the locating structure.

17. The method of claim 15 wherein the grate is prevented from being lifted vertically by engagement of at least one cup member, provided on at least one rear corner ear portion of the grate, with a pair of projections of the locating structure.

18. The method of claim 17, wherein the at least one cup member includes a pair of cup members, with each of said pair of cup members being defined by a lower rear wall portion, an arcuate wall portion, a top wall portion and an open bottom portion for receiving a respective one of said pair of projections, and wherein, after the grate is positioned over the at least one heating element, the grate can be vertically lifted from the cooktop with the pair of projections sliding through the open bottom portions of the pair of cup members.

19. The method of claim 18 wherein, upon pivoting the grate through a predetermined angle, the lower rear wall portion extends below a portion of a respective said one of said pair of projections, thereby preventing the grate from being vertically lifted from the cooktop.

20. The method of claim 15, further comprising: assisting in pivoting the grate relative to the at least one cooking element with a lift assist unit provided on the cooktop.

* * * * *